United States Patent [19]

Zimmern

[11] 4,043,704

[45] Aug. 23, 1977

[54] DOUBLE-ACTING ROTARY EXPANSIBLE CHAMBER PUMP ADAPTABLE TO SERIES OR PARALLEL OPERATION

[75] Inventor: Bernard Zimmern, Neuilly-sur-Seine, France

[73] Assignee: Uniscrew Limited, Hamilton, Bermuda

[21] Appl. No.: 596,060

[22] Filed: July 15, 1975

[30] Foreign Application Priority Data

Aug. 5, 1974 France ..... 74.27132

[51] Int. Cl.[2] ..... F04B 23/04

[52] U.S. Cl. ..... 417/62; 418/10; 418/13; 418/159

[58] Field of Search ..... 418/10, 9, 195, 13, 418/159, 180; 417/62, 440

[56] References Cited

U.S. PATENT DOCUMENTS

| | | | |
|---|---|---|---|
| 1,989,552 | 1/1935 | Good | 418/195 |
| 2,904,012 | 9/1959 | Hazen | 417/62 |
| 2,991,930 | 7/1961 | Lindner | 418/159 |
| 3,133,695 | 5/1964 | Zimmern | 418/195 |
| 3,151,806 | 10/1964 | Whitfield | 418/159 |
| 3,381,891 | 5/1968 | Bellmer | 417/62 |
| 3,788,770 | 1/1974 | Johnson et al. | 417/62 |

*Primary Examiner*—Carlton R. Croyle
*Assistant Examiner*—Thomas I. Ross
*Attorney, Agent, or Firm*—Lane, Aitken, Dunner & Ziems

[57] ABSTRACT

In a double-acting rotary compressor having two compression spaces each constituted by at least one variable-volume compression chamber which is put into communication first with the suction enclosure and then with the discharge enclosure, the power consumption at low delivery is reduced by causing the two compression spaces to discharge in parallel into a common duct in the vicinity of maximum delivery and connecting the spaces in series for deliveries below a predetermined value by joining the outlet of the first space to the second space at a point at which the compression chamber is already isolated from the suction enclosure.

8 Claims, 22 Drawing Figures

P
Q
100%
50
p
v
p1
p0
v1
v0
p'0
p''0 p
v
v1
v0
18
22
56
57
58
59
60
61
62 p1
p0
v
v1
v0
18
21
22
24
47
50
51
52
53
54
55 p1
p0
v
v1
v0
18
21
22
70
71
72
73
74
75
99
100
101
102
103
109
110
111
112
113
114
115
116
117
118
119
126 p1
p0
v
v1
v0
18
21
22
56
70
71
72
73
74
75
76
77
78
79
80
81
82
83
84
85
86
88
89
90
91
92
93
94
95

DOUBLE-ACTING ROTARY EXPANSIBLE CHAMBER PUMP ADAPTABLE TO SERIES OR PARALLEL OPERATION

This invention relates to a method for regulating double-acting rotary compressors in order to reduce the power consumption at the time of operation at low output. The invention also relates to devices for carrying said method into practical effect.

Positive-displacement rotary compressors of either the sliding-vane or worm type, for example, have an invariable volumetric compression ratio which is defined by the particular design of the machine. By volumetric compression ratio is meant in this case the ratio of the volume of a compression chamber at the moment when this latter closes to the admission to the volume of said chamber when it opens to the discharge.

When the compressor is operated at low values of delivery by making use of known methods such as the creation of a vacuum at the intake by throttling this latter, for example, the compression chamber opens to the discharge before the gas contained in said chamber has attained the discharge pressure; this phenomenon does not take place in piston compressors in which the discharge valve is lifted only when the pressure within the cylinder attains the discharge pressure. At low delivery, rotary compressors consequently have unsatisfactory thermodynamic efficiency which is usually lower than that of piston compressors.

Attempts have already been made to overcome this disadvantage by making provision for variable-section discharge openings which permit the possibility of varying the compression ratio as a function of the delivery. These arrangements, however, are both complex and costly.

One of the aims of the present invention is to permit the application of a method for regulating double-acting rotary compressors so as to retain high thermodynamic efficiency by making use of simple means which entail low capital expenditure.

In accordance with the invention, the method for regulating double-acting rotary compressors in order to reduce the power consumption at a low delivery, a compressor of this type being defined as comprising two compression spaces each constituted by at least one variable-volume compression chamber which is successively put into communication with the suction enclosure, then isolated and finally put into communication with the discharge enclosure, consists in causing the two spaces aforesaid to discharge in parallel into a common duct in the vicinity of maximum delivery and is distinguished by the fact that, in the case of deliveries below a predetermined value, the two spaces aforesaid are connected in series by joining the outlet of a first space to the second space at a portion of said second space at which the compression chamber is already isolated from the suction enclosure.

The reduction in power consumption at low values of delivery is thus much greater than that observed by applying known methods.

The two compression spaces are preferably placed in series when the delivery falls below 80% of its maximum value and in particular when said delivery falls below a value within the range of 50% to 70% of the maximum delivery.

The method thus defined can be combined with any flow-regulating means.

In a preferred embodiment of the method, the compression chambers are isolated from the suction enclosure before said chambers have attained their maximum volume.

Thus the gas first undergoes expansion between the point at which filling of the chamber is stopped and the point at which the chamber attains its maximum volume and the work produced by said expansion is recovered. Moreover, when the two spaces are connected in series, it is also possible to recover the greater part of the compression work performed by the expansion of gas of the first-stage space which discharges into the second-stage space.

A further aim of the invention is to provide a device for regulating double-acting rotary compressors in order to carry out the method aforesaid.

In accordance with the invention, the device for regulating a double-acting rotary compressor defined as comprising two compression spaces each constituted by at least one compression chamber provided with moving partition-walls in cooperating relation with a casing, said casing being provided with at least one orifice for the admission of the gas to be compressed, is distinguished by the fact that said casing is provided in the portion corresponding to the second space with an additional orifice connected by a pipe to the discharge of the first space, the dimension of said additional orifice being substantially inscribed within the contact area between said casing and one of the moving partition-walls aforesaid, and the position of said additional orifice being such that a compression chamber does not communicate simultaneously with said orifice and with one or a number of the gas admission orifices aforesaid in any position of the moving partition-walls aforesaid.

Thus the above-mentioned orifice is prevented from establishing a harmful communication between two adjacent chambers. Furthermore, the gas which is compressed within the first-stage space and discharged into the second-stage space is prevented from escaping through the suction orifices.

In a preferred embodiment of the invention, the device comprises displaceable closure elements for progressively closing-off the orifices aforesaid.

It is thus possible to isolate the compression chambers from the suction enclosure before said chambers have attained their maximum volume.

Further particular features of the invention will become apparent from the following detailed description, reference being made to the accompanying drawings which are given by way of example without any limitation being implied, and in which.

Figures 1, 2, 3, 4, 5, 6:
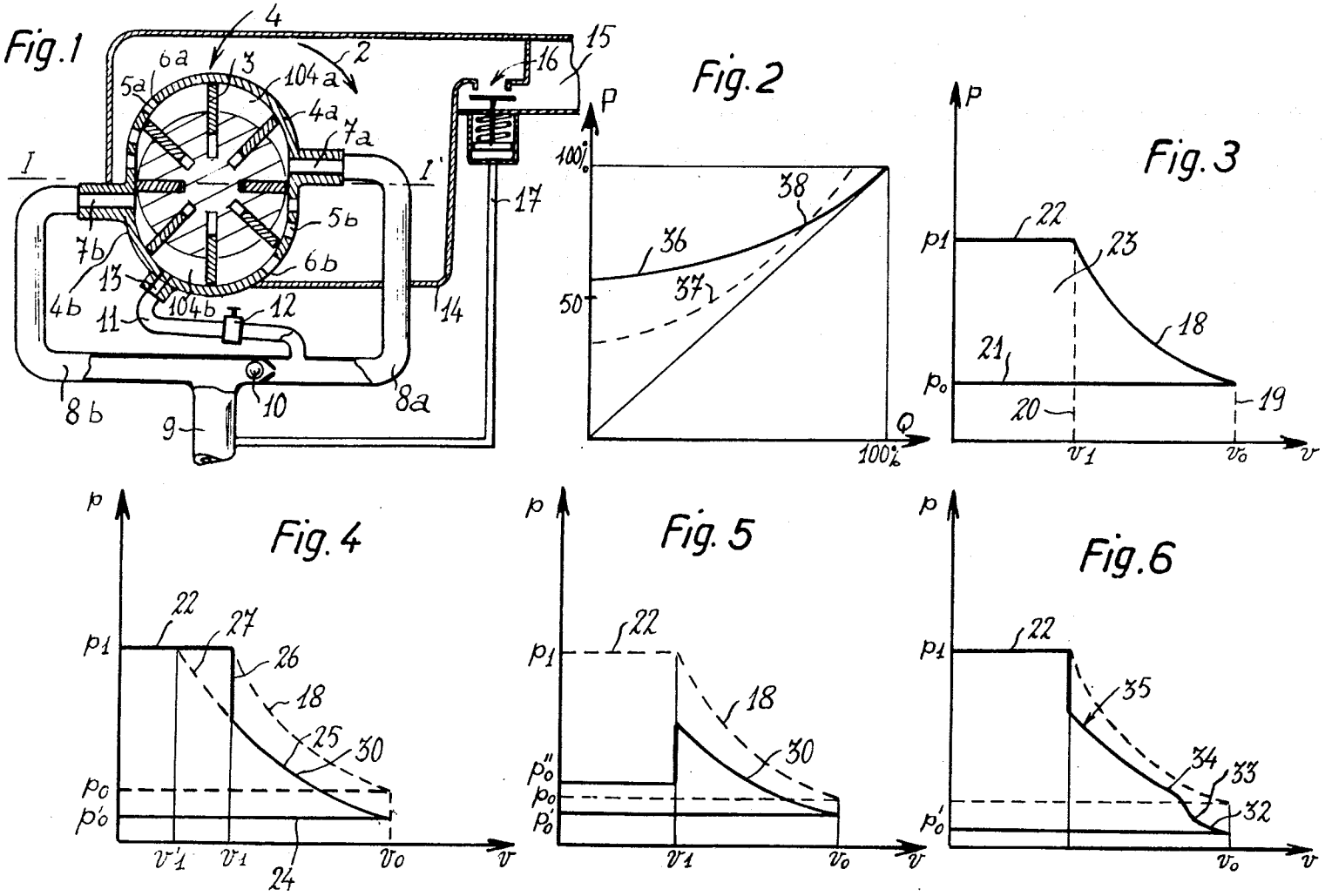
FIG. 1 is a semi-diagrammatic sectional view of a double-acting sliding-vane compressor equipped with a regulating device in accordance with a first embodiment of the invention.
FIG. 2 is a diagram of the power consumed by said compressor as a function of the delivery.
FIGS. 3, 4, 5 and 6 are thermodynamic diagrams which illustrate the operation of the compressor aforesaid.

Referring to FIG. 1, a double-acting sliding-vane compressor comprises a rotor 1 which is intended to rotate in the direction of the arrow 2 and carries vanes 3. Said vanes slide within the rotor and are in rubbing contact with a stationary casing 4, said casing being substantially symmetrical with respect to a line I–I′ which passes through the center of the rotor. There can be seen on said casing two portions 4*a*, 4*b* which are located on each side of the line I–I′ but are not necessarily separate from each other in the physical sense. Ports 5*a*, 5*b* are provided in known manner on a fraction of the periphery of the casing 4*a*, 4*b*. The gas penetrates through said ports into the interior of chambers 104*a*, 104*b* which are formed by two successive vanes 3 and the casing 4. Since the two portions of the casing which are divided by the line I–I′ are displaced off-center with respect to the axis of the rotor 1 the volume of either of these chambers varies when the rotor 1 is rotating. Said volume is of maximum value when the chamber has a plane of symmetry at right angles to the line I–I′. The position of the ports 5*a*, 5*b* is such that at least one port remains in communication with the chamber 104*a*, 104*b* until the moment when this latter attains its maximum volume. Beyond the points 6*a*, 6*b*, the casing is no longer provided with any opening except two discharge ports 7*a*, 7*b* formed in the casing in the vicinity of the plane of symmetry with is designated in the figure by the line I–I′. The symmetry of the compressor as indicated in the drawing is mentioned solely by way of example and need be only approximate.

The discharge ports 7*a*, 7*b* are connected to pipes 8*a*, 8*b* which are united to form a common duct 9, said duct being in turn connected to elements such as a pressure drum (not shown) which are placed on the downstream side of the installation.

A check valve 10 is mounted in the pipe 8*a*; there is connected between the valve 10 and the discharge 7 a pipe 11 which is fitted with a shut-off valve 12 and connected to a port 13 formed in the compressor casing.

The distance between the point 6*b* and the port 13 is intended to be greater than the distance between two successive vanes, with the result that the port 13 is only in communication with compression chambers which are already isolated from the inlet ports 5*b*.

An outer casing or enclosure 14 surrounds the compressor and is connected to an inlet duct 15 fitted with a valve 16 which can be actuated by the pressure of the compressed gas which comes from the outlet of the compressor via a pipe 17 and can thus progressively close-off the intake when the delivery pressure of the compressor attains a predetermined value.

For example, if atmospheric air is compressed to 7 bars, the valve will begin to close at a delivery pressure of 7 bars and will be fully closed at 8 bars. The valve will be partially closed between 7 and 8 bars, thus producing a pressure drop at the level of the valve-seat, with the result that the pressure within the outer casing 14 is reduced to values below atmospheric pressure.

By means of this known device, the pressure at the inlet ports 5*a*, 5*b* can accordingly be adjusted continuously to any value within the range of 0 to 1 bar absolute.

The operation of the compressor herein described will now be explained on the assumption that the device in accordance with the invention does not come into operation.

For the sake of enhanced clarity of the description, the expression "first-stage space" as used hereinafter will be understood to designate that section of the compressor which is constituted by the set of inlet ports 5*a* of the portion 4*a* of the casing, by the discharge port 7*a* and by the vanes which cooperate with the portion 4*a* of the casing so as to form compression chambers. The expression "second-stage space" as used in the following description will be understood to refer to that section of the compressor which is constituted by the set of inlet ports 5*b* of the portion 4*b* of the casing, by the discharge port 7*b* and by the vanes which cooperate with the portion 4*b* of the casing. The definition of spaces just given is solely structural and inherent to this specification. In consequence, it cannot be considered in any sense to imply a mode of operation which is comparable with that of conventional multistage compressors.

When the compressor is operating at full capacity, the shut-off valve 12 is closed. The check valve 10 is then open and the first and second-stage spaces aforesaid compress in parallel and discharge simultaneously into their pipes which are connected to the duct or enclosure 9.

If the discharge pressure of the compressor exceeds a predetermined value, said pressure causes the progressive closure of the valve 16 so as to initiate a reduction of delivery. This results in a reduction of consumed power. The curve 36 shown in FIG. 2 represents a plot of the variation in consumed power as a function of the delivery when making use solely of the known device which is constituted by the valve 16. In FIG. 2, the axes are graduated as percentages of the maximum values. This curve corresponds to the following experimental data:

Compressed fluid: air
Suction pressure: 1 bar absolute
Discharge pressure: 8.2 bars absolute
Volumetric compression ratio: 4.5

Under these conditions, it has been found that in the case of a delivery of 50%, the consumed power dropped to 81%, the discharge pressure being maintained at 8.2 bars. At zero delivery, that is to say by creating an absolute vacuum on the suction side, the power drops to 63%.

The operation of the regulating device in accordance with the invention will now be described.

When the pressure on the suction side of the compressor attains a value below 80% and preferably between 50% and 70% of the value of the normal suction pressure, the valve 12 is opened, thereby establishing a communication between the pipe 8*a* and the compression chambers located opposite to the port 13. Said port 13 has been located at a point of the casing at which the opposite chamber is isolated from the intake; said port 13 is also located, however, so as to ensure that the mean pressure within said chamber is of low value and preferably below one-half the pressure attained within the chamber at the moment of discharge through the port 7*b*. In consequence, the pressure which develops within the pipe 11 is lower than the pressure within the duct 9 and the check valve 10 accordingly closes.

It would be possible to adopt arrangements other than the combination of a shut-off valve and a check-valve without departing from the scope of the invention. For example, the pipe 8*a* could be connected alternately to the duct 9 or to the pipe 11 by means of a three-way valve, for example.

When this connection is thus established, the first-stage space and the second-stage space no longer deliver in parallel but in series and the curve 37 plotted in FIG. 2 represents the variation in consumed power as a function of the delivery when this type of operation is adapted. The curve 37 has been obtained from the same experimental data as the curve 36.

It has been found that, in the case of a 50% delivery, the consumed power dropped to 72% and dropped to 31.5% at zero delivery. These values are distinctly lower than those obtained by means of known devices.

The two curves 36 and 37 intersect at a point 38 corresponding to a delivery of approximately 72% in the example described. It is therefore apparent that an advantage is to be gained by operating with the spaces in parallel above the aforementioned value of delivery and by operating with the spaces in series below this value.

A tentative explanation of this surprising result can be found in the following consideration although it will be understood that the validity of these latter cannot be deemed to affect the scope of the invention.

The thermodynamic compression diagram in the case of the known mode of operation in parallel is shown in FIG. 3 in which there have been plotted as abscissae the volume of a chamber during rotation and especially at 19 and 20 the volumes $v_0$ and $v_1$ of the chamber corresponding to the maximum volume (at the moment when the chamber moves away from the point 6*a* or 6*b*) and to the volume at the moment when the chamber opens to the discharge port; the delivery pressures $p_0$ and $p_1$ have also been shown on the lines 21 and 22.

The lines 21, 18 and 22 represent in known manner the relationship between the volume and the pressure during a cycle and it is known that the work input to the compressor or compression work is proportional to the area 23 comprised between these three lines and the axis of ordinates.

When the valve 16 closes progressively, the pressure on the suction side decreases an the compression cycle is deformed as represented in known manner in FIG. 4; the intake pressure becomes $p'_0$ and the relationship between pressure and volume is represented by the series of lines 24, 25, 26 and 22.

The input or compression work is reduced with respect to FIG. 3 but is far from being of optimum value, especially by reason of the fact that the pressure within the chamber is put into communication with the discharge when the volume is reduced to $v_1$. This results in an abrupt increase in pressure to the value $p_1$as shown in FIG. 4. If it were possible to displace the point of opening and to reduce the volume to $v'_1$ before discharge occurs, the compression curve would be constituted by the line 25, the line 27 and a portion of the line 22, thus economizing the work represented by the area between the lines 22, 26 and 27.

An explanation will now be given in regard to the operation of the compressor when the two spaces are connected in series in accordance with the invention.

FIG. 5 represents the pressure-volume diagram of the first-stage space. Suction takes place at the pressure $p'_0$ and is followed by adiabatic compression along line 30, then by discharge at a pressure $p''_0$ and along line 31. The pressure $p''_0$ is substantially equal to the pressure which exists within a compression chamber of the second-stage space when said compression chamber is about to interrupt its communication with the port 13. In the case of a compressor having a volumetric compression ratio of 4.5, the port 13 being so arranged as to communicate with a compression chamber as soon as this latter no longer communicates with the intake and in the case of a gas such as air, said pressure $p''_0$ is substantially of the order of 2.6 to 2.8 times $p_0$.

If $p_0$ is equal to 0.5 bar absolute, $\mathbf{p}''_0$ is therefore of the order of 1.3 and 1.4 bars absolute. This value is therefore much lower than $p_1$ which is approximately 8 bars absolute under the same conditions. This results in a considerable saving of power in the work performed by the first-stage space.

FIG. 6 represents the pressure-volume diagram of the second-stage space.

Suction takes place at the pressure $p'_0$ and is followed by incipient adiabatic compression along line 32, then by a more rapid pressure rise along line 33 when the gas derived from the first-stage space passes through the port 13 to the point 34 at which the pressure attains substantially the value $p''_0$ and at which the chamber is then no longer in communication with the port 13, then by an adiabatic compression line 35 and by discharge along line 22 at the pressure $p_1$. The work performed by said space is of slightly higher value than would be the case if both spaces were operating in parallel but the increase in work is smaller than the gain achieved in regard to the first-stage space, at least when the intake pressure $p'_0$ is lower than 80% of the normal pressure $p_0$ and within the range of 50 to 70%, depending on the compression ratios.

The two compression spaces can in any case be advantageously placed in series independently of any regulation of the compressor delivery, for example when the pressure ratio between the suction and discharge tends to exceed a predetermined value.

This case arises for example in refrigerating compressors in which, if the low-temperature requirement is inadequately met at the evaporator, the temperature of the evaporator and therefore the pressure of the cold-producing gas on the suction side of the compressor have a tendency to decrease; the delivery therefore becomes a partial delivery independently of any means for reducingg this latter, solely under the action of the temperature drop of the evaporator.

If the discharge pressure is constant as is generally the case, the ratio of the inlet pressure to the outlet pressure tends to increase and substantially exceed the normal compression ratio for which the apparatus has been built and for which the discharge ports have been designed. Starting from a given value which can readily be calculated and with reference to the pressure-volume diagrams in accordance with the procedure outlined in the foregoing, an advantage is secured if the two compression spaces are no longer operated in parallel but are caused to work in series.

In general, the position of the port 13 is not critical provided that the oppositely-facing chamber is isolated from the intake. If the port 13 is displaced towards the high-pressure side, this in fact has the effect of increasing the discharge pressure of the first-stage port and therefore the work produced by the first stage but the compression work of the second stage is reduced, the two phenomena being substantially compensated over a fairly broad range of possible positions.

Figure 7:
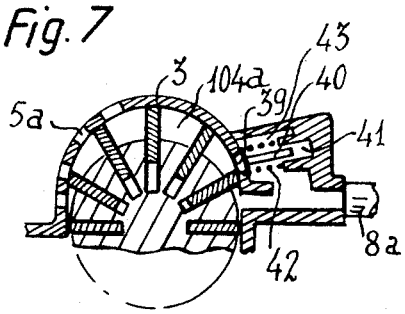
FIG. 7 is a partial semi-diagrammatic sectional view of the same compressor equipped with a regulating device in accordance with a second embodiment of the invention.

FIG. 7 illustrates an alternative embodiment of the invention which is preferably applicable to the case of a high volumetric compression ratio attaining in particular values which are higher than 4 and between 8 and 10, for example. In this case, in the example for the sliding-vane compressor considered in the foregoing, the number of vanes on the rotor is higher than that shown in FIG. 1.

It is accordingly an advantage to make provision in the casing for a disc-valve 39, the stem 40 of which is slidably fitted within a guide bore 41 and which is held against its seat by a spring 42.

A chamber 43 formed within the casing behind said disc-valve is connected to the pipe 8*a*.

The position of the disc-valve in the casing is determined so as to ensure that the compression ratio attained by a compression chamber at the moment when the first vane forming one of the partition-walls of said chamber is passing in front of said disc-valve is slightly higher than 2. When the two compression spaces are placed in series as a result of opening of the shut-off valve 12, the pressure established within the pipe 8*a* is slightly higher than twice the value of the intake pressure as mentioned above. As a result, the pressure within the compression chamber aforesaid lifts the disc-valve which remains continuously open and the first stage therefore discharges with a compression ratio in the vicinity of 2; this represents an appreciable gain in power and avoids the need to compress the gas of the first stage to the normal compression ratio as this serves no useful purpose.

Figure 8:
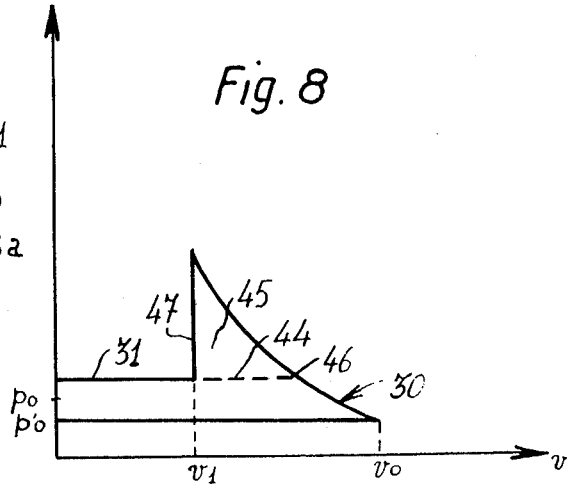
FIG. 8 is a thermodynamic diagram which illustrates the operation of the compressor shown in FIG. 7.

An explanation of the advantage offered by this device may be attempted by considering the pressure-volume graph shown in FIG. 8. Without a disc-valve, the compression would follow the curve 30, 47 and 31. When provision is made for the disc-valve 39, the compression takes place along the curve 30 up to the point 46, then along the curve 44 and the curve 31, the saving of energy thus achieved being represented by the area 45 enclosed between said curves 30, 47 and 44.

It is readily apparent that, apart from the disc-valve 39, there also exist other means such as discharge ports having a continuously variable cross-section which could be employed without altering the nature of the invention or the result achieved.

Figure 9:
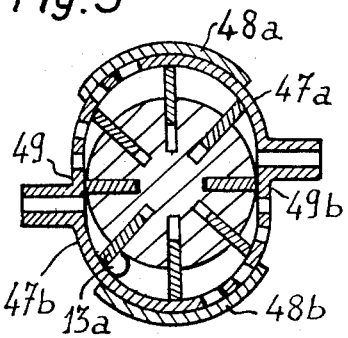
FIG. 9 is a partial semi-diagrammatic sectional view of the same compressor equipped with a regulating device in accordance with a third embodiment of the invention.

Another particularly remarkable arrangement combines the present invention as described in the foregoing with a flow-regulating device which will be described with reference to FIGS. 9 to 11.

In this arrangement, the outer wall of the casing within which the rotor is intended to rotate has a cross-section in the shape of two semicircles 47*a*, 47*b* which are joined to each other by portions such as those designated by the references 49*a*, 49*b*.

Figure 10:
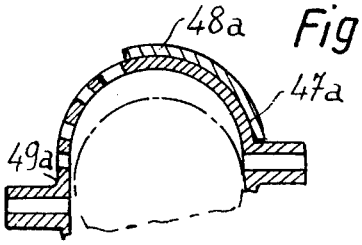
FIGS. 10 and 11 are two partial views of FIG. 9 showing the device aforesaid in particular positions.
Figure 11:
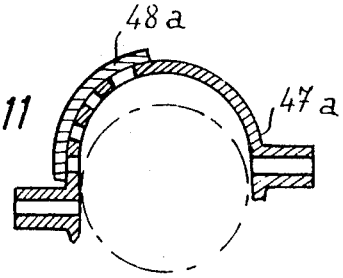

Two quarter-circle shells 48*a*, 48*b* are capable of moving in fluid-tight manner against the semicircles 47*a*, 47*b* and of continuously occupying each position between the two end positions shown in FIGS. 10 and 11. The valve 16 of FIG. 1 is dispensed with.

Moreover, the port 13 is displaced and transferred to one of the lateral faces of the casing of the sliding-vane compressor, at 13*a*.

The regulating operation is accordingly carried out as follows: by rotating the shells 48*a*, 48*b* either simultaneously or even separately by means of devices which have not been illustrated, the inlet ports 5*a*, 5*b* are progressively closed-off. In consequence, filling of the chambers is effected only over a fraction of the cycle which is shorter as the shell is closer to the position in FIG. 11.

The regulating device can be improved even further by associating it with a device known per se for retarding the discharge and therefore increasing the compression ratio by reducing the outlet. By way of example, a device of this type can consist in arranging the discharge orifice so as to form two or more ports which are normally open but one or a number of which can be closed-off at will by means of controlled valves.

Figure 16:
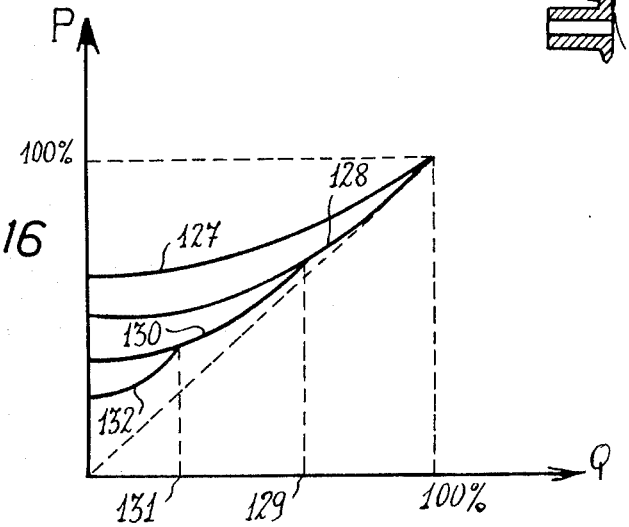
FIG. 16 is a diagram showing the power consumed as a function of the delivery in the case of different embodiments of the invention.

FIG. 16 shows curves which plot the power consumed as a function of the delivery in the case of an air-conditioning compressor which operates with Freon-22 and has a volumetric compression ratio of 3, in which the mechanical losses are substantially constant irrespective of the delivery and are equal to 15% of the power under full load.

Curve 127 indicates the power when the variation in delivery is obtained by throttling on the suction side. Curve 128 indicates the power obtained when the two spaces operate in parallel, the regulation being obtained by early intake closure, for example by means of the shells 48*a*, 48*b*.

If the two compression spaces are placed in series when the delivery attains approximately the value of 60% represented in the figure by the point 129, the power follows the curve represented by the curve 130. Finally, if the outlet of the second stage is reduced by means of a valve when the delivery attains 30% (point 131) and the compression ratio of this stage is thus brought to approximately 6.5, the power accordingly follows the curve 132.

When the compression spaces are placed in series, the power consumed at 50% of maximum delivery is approximately 59% and falls to less than 40% in the case of a delivery equal to 30% of maximum delivery.

The power at zero delivery is approximately 50% in the case of series connection without any change in the compression ratio of the second stage and falls to the vicinity of 30% with a change in the compression ratio.

These results are fairly remarkable when compared with the results obtained in modern rotary compressors of known type; non-symmetrical double-worm rotary compressors of the type disclosed in U.S. Pat. No. 3,314,597, for example, would in fact consumed under similar conditions approximately 65% of the total power at 50% delivery and 45% of 10% delivery. Furthermore, the devices with which these compressors are equipped do not usually make it possible to attain zero delivery.

It will be endeavored to give an explanation of these surprising results by considering the thermodynamic diagrams relating to the operation of the devices described although that feasibility of this explantion cannot be considered to imply any limitation in the general purview of the invention.

Figure 12:
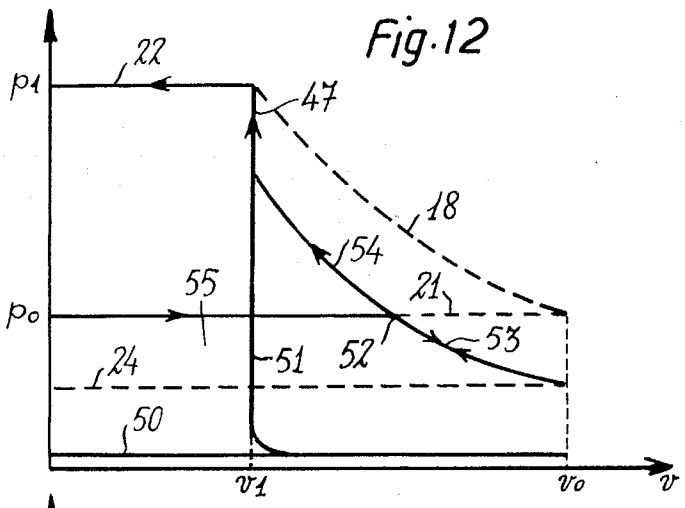

FIG. 12 represents the pressure-volume diagram corresponding to different positions of the shells 48*a*, 48*b*.

The path represented by the lines 21, 18 and 22 corresponds to the position of FIG. 10, that is, to the maximum value of delivery.

On the contrary, in the position of FIG. 11 in which the intake is fully closed, the pressure is practically zero throughout the period of expansion of the chamber and during the compression period, then rises abruptly to the pressure $p_1$ when the chamber comes into position in front of the discharge port (curves 50 and 51).

When the inlet ports 5*a*, 5*b* are partially closed-off by the shells 48*a*, 48*b*, the chamber is filled at the intake pressure $p_0$ until the moment when said chamber attains the volume represented in the figure by the point 52 and when it is accordingly isolated from the intake by the shell 48*a* for the shell 48*b*.

As the volume of the chamber continues to increase, so the pressure decreases in accordance with curve 53 to the volume $V_0$, then again increases substantially in accordance with the same curve 53, returns through the point 52, then follows the compression curve 54, 47 and 22.

If the regulation had been carried out by means of the vacuum-producing device which is shown in FIG. 1 and comprises the valve 16, the diagram would have begun to follow the line 24 instead of the line 21. It is therefore apparent that the device under consideration makes it possible to gain the entire quantity of energy represented by the area 55 bounded by the curves 21, 24 and 53.

This area corresponds to the fact that, with the arrangement proposed, the gas is caused to perform driving work from the point 52 and that this work is substantially equal to the compression work which is necessary in order to return to the same point 52, whereas said driving work is lost when the operation is carried out simply by throttling the intake.

In order to achieve this recorvery with maximum efficiency, it is necessary to ensure that the inlet ports 5*a*, 5*b* are not of greater width than the thickness of the sliding vanes 3 in order to prevent the spaces which are located on each side of any one vane from being put into communication with each other as they pass in front of a port as this would result in pressure equalization without any driving work being performed. In addition, the casing must necessarily have a small thickness at the level of the inlet ports 5 in order to ensure that the volume of gas which may be trapped within an inlet port 5 as a vane passes is negligible in comparison with the volume of the compression chamber and is not liable to interfere to any appreciable extent with the progressive pressure change within the chambers as a result of successive compression and expansion at the time of passage of the vanes.

Figure 13:
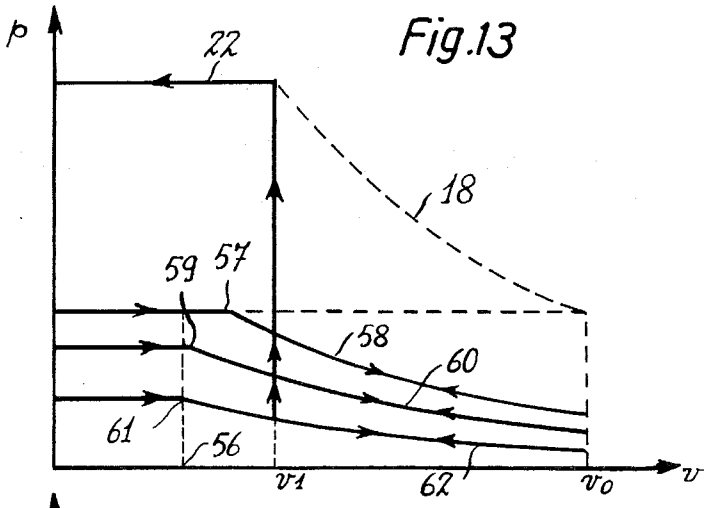
FIGS. 12 to 15 are thermodynamic diagrams illustrating the operation of the same compressor.

Referring now to FIG. 13, consideration will be given to the operation of the device when the shells 48*a*, 48*b* come close to their fully closed position (as shown in FIG. 11).

The volume of the chamber which remains in communication with the intake is in that case not zero and assumes a limiting value represented by the point 56. When the shells 48*a*, 48*b* come near their closed positions, a progressive throttling of the intake accorrdingly takes place. There have been shown different cycles in the vicinity of closure and it is apparent that, after a commencement of filling which takes place at decreasing pressures and starting from the points 57, 59 or 61, there takes place an expansion in accordance with curves 58, 60 or 62 followed by recompression. The arrows indicate the direction of displacement on the pressure-volume graph.

In contrast to known regulating means which consist for example in varying the delivery by retarding the closure of the chambers and thus reducing the volume entrapped within these latter, the regulating device under consideration makes it possible to attain zero delivery, which is not the case with the other known means aforesaid. In this respect, the device according to the invention therefore makes it possible to vary the delivery from 100 to 0% in the same manner as throttling at the intake described earlier but is considerably superior in regard to thermodynamic efficiencies.

Figure 14:
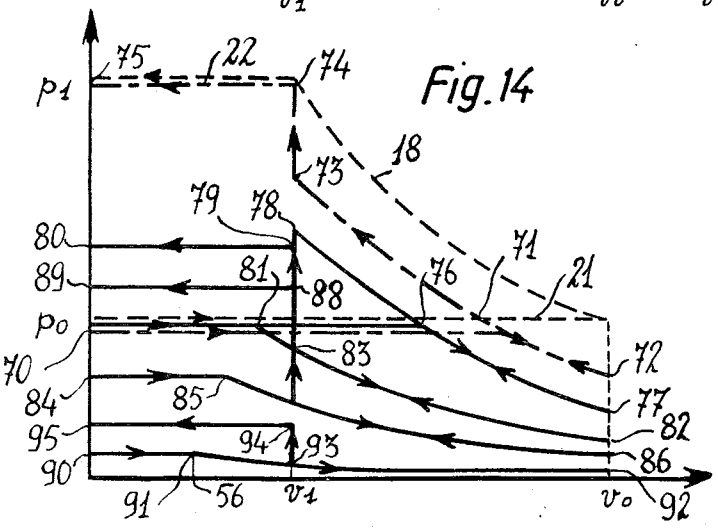

Now if the shut-off valve 12 is opened, the two compression spaces are placed in series and the pressure-volume diagrams of the first space become those shown in FIG. 14 in which the compression cycle 70 at maximum delivery is recalled by means of the dashed lines 21, 18, 22, 75.

The cycle 70, 71, 72, 71, 73, 74, 75 shown in chain-dotted lines in the figure is obtained when the two stages operate in parallel and the shut-off valve 12 is closed.

When the shut-off valve 12 is opened while displacing the shells 48*a*, 48*b* in the direction of closure, there is thus obtained a cycle such as 70, 76, 77, 76, 78, 79, 80; then, as the shell 48is closed even further, there is obtained a cycle such as 70, 81, 82, 83, 79, 80; then 84, 85, 86, 87, 88, 89; then 90, 91, 93, 94 and 95.

Figure 15:
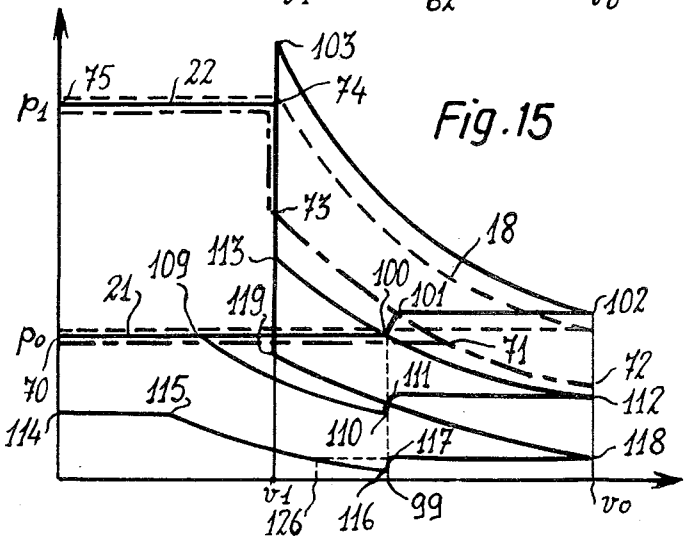

The discharge pressures represented in the figure by points such as 80, 89 or 95 represent slightly more than twice the value of the corresponding discharge pressures indicated respectively at 70, 84 or 90. The different pressure-volume cycles followed by the second-stage space are shown in FIG. 15.

As long as the two compression spaces operate in parallel, there are followed full-delivery cycles such as 21, 18, 22 (shown in dashed lines); or partial-delivery cycles such as 70, 71, 72, 71, 73, 74, 75 (shown in chain-dotted lines) which are identical with those followed by the first space.

However, when the compression spaces are placed in series and when the volume of the chamber attains the value designated in the figure by the reference 99, the chamber is filled with gas supplied from the first space; this volume corresponds to the volume of the chamber when this latter begins to come into position in front of the port 13'.

Cycles such as 70, 100, 101, 102, 103, 74, 75 are obtained. Then, if the shells 48*a*, 48*b* are displaced simultaneously, cycles such as 70, 109, 110, 111, 112, 113, 74, 75, then 114, 115, 116, 117, 118, 119, 74, 75 are obtained.

It is a rather remarkable fact that, during expansion of the chamber, the pressure does not decrease constantly with the expansion of the volume but stabilizes substantially as represented by the horizontal lines or plateaux such as those designated by the references 101, 102 or 111, 112.

The expansion of the chamber is in fact accompanied by filling with gas discharge from the first stage and it is found that the driving work performed by the first-stage space for the discharge is almost entirely recovered.

The action of the compressor is almost exactly the same as that of a two-stage compressor.

Said compressor would have strictly the same behavior as a two-stage compressor if the point 99 were displaced towards the left-hand side of the diagram up to the point 126 and therefore if the port 13*a* were advanced towards the commencement of discharge. The volume occupied by the chamber at the point 126 would in that case be substantially one-half the volume $v_0$.

It may nevertheless be an advantage to provide the intake at a point such as 99 at which the volume is slightly larger than one-half the volume $v_0$. In fact, the device is capable of operating only if the chamber which arrives in front of the port 13*a* is already isolated from the intake by the shell 48*b*. If this were not the case, the first-stage gas which has already been compressed would flow back through the chamber towards the suction side; in consequence, as the port 13*a* is advanced further towards the beginning of the intake, so the shell 48*b* must also be engaged to a further extent in the direction of the intake and placing of the compression spaces in series can therefore be carried out only by employing partial deliveries of lower value.

Thus if it is desired to have a compressor which operates in the same manner as a two-stage compressor with establishment of communication corresponding to the joint 126, this means that the compression spaces can be placed in series only when the delivery is lower than approximately 50%.

In point of fact, power can already be gained by connecting in series at values of delivery which can be of the order of 60, 70% or even higher according to operating conditions.

It may therefore prove advantageous to make a slight sacrifice in efficiency of the cycle below 50% in order to achieve a gain in efficiency above 50%.

A further solution consists in displacing the port 13*a* progressively as the shell 48*b* is displaced so as to ensure that the chamber located opposite to the port 13*a* is always isolated from the intake by placing the port 13*a* on the shell 48*b*, for example, and by providing the opposite casing 16 with ports which are capable of communicating in succession with the port 13*a* during displacement of the shell 48*b*.

Yet another solution also consists in taking steps to ensure that the displacement of the shells 48*a*, 48*b* is not angularly identical, that for example the delivery of the first stage is reduced first, then maintained at approximately 80% of the delivery of the second stage and that the port 13 in the second stage is opened at a point at which the volume of the chamber of said second stage attains 60 % of the maximum volume.

The overall result thereby achieved is that the combination of the device for creating a vacuum by early closure of the suction chamber and placing the two stages in series makes it possible to establish a closer relationship between the thermodynamic compression cycle and the ideal compression cycle, which applies to most values of partial delivery. Coincidence is total at maximum delivery and at values of delivery in the vicinity of 50%. On the other hand, there is a deviation from total coincidence at very low values of delivery. This can be remedied, however, by incorporating in the second space a device for retarding the discharge and therefore increasing the compression ratio while reducing the discharge opening as has been explained earlier.

The present invention which is described in connection with a sliding-vane compressor is applicable to any double-acting compressor which may or may not be totally symmetrical, that is to say in which the two compression spaces have identical or only slightly different swept volumes.

Figure 18:
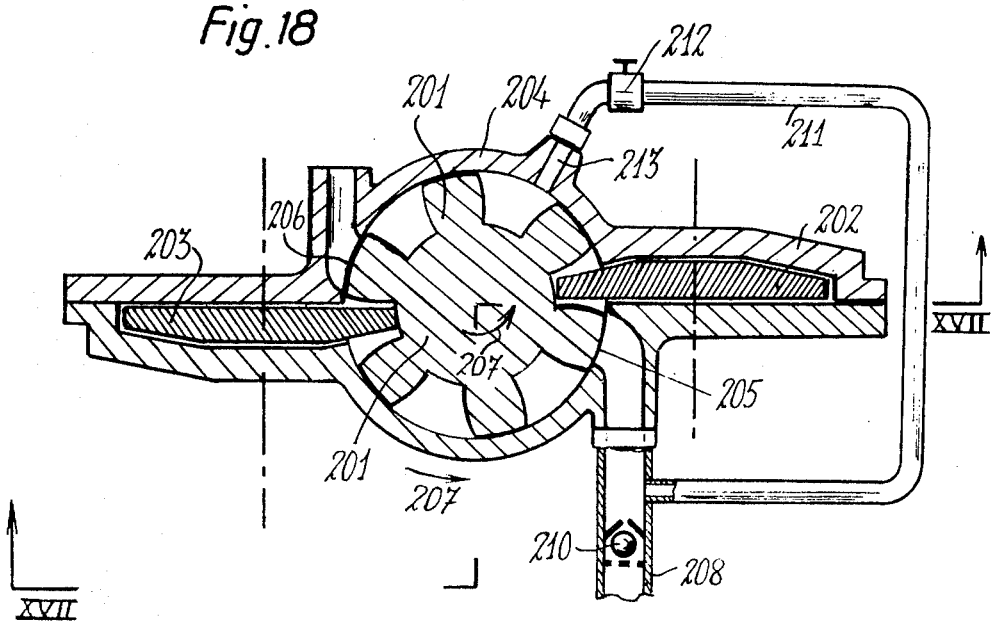
FIG. 18 is a sectional view taken along line XVIII—XVIII of FIG. 17.
Figure 19:
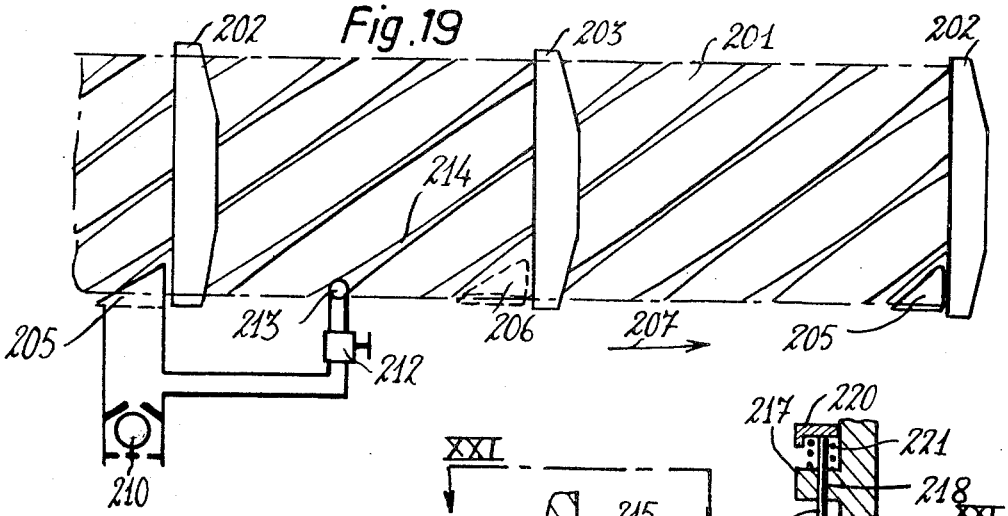
FIG. 19 is a developed view of the worm of FIG. 17.

The present invention applies in particular to all single-worm compressors of the type disclosed in French Pat. Nos. 1,268,586, 1,287,593, 1,331,998, 1,586,832, 1,601,531, when these compressors are constituted by a worm in cooperating relation with two pinions and thus define double-acting compressors having two compression spaces which can be substantially symmetrical with respect to the axis of the worm, There is shown by way of example in FIGS. 17, 18 and 19 a single-worm compressor in accordance with French Pat. No. 1,331,998 and modified in accordance with the present invention.

Figure 17:
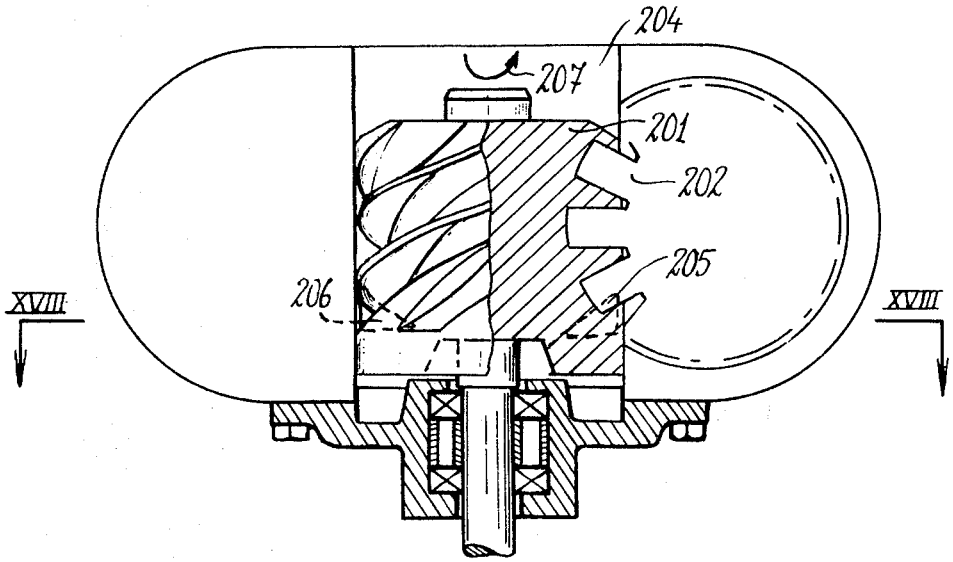
FIG. 17 is a half-sectional view in elevation along line XVII—XVII of FIG. 18 and showing a globoidal-worm compressor equipped with a device in accordance with a first embodiment of the invention.

FIG. 17 is a view taken partly in elevation in which the casing and pinion have been removed on the left-hand side and partly in cross-section on the right-hand side showing a cylindrical single-worm compressor in cooperating relation with two flat pinions. This compressor comprises in particular a worm 201 which rotates in the direction of the arrow 207, a pinion 202, the symmetrical pinion 203 having been removed, and a casing 204 which surrounds the worm.

Two discharge ports 205 and 206 (shown in FIG. 18) are formed on each side of the plane of the pinions 202 and 203; the position of the port 205 is shown in dashed outline in FIG. 17. The casing 204 of the compressor is connected to a device for regulating delivery by reducing the intake pressure; this device is similar to that described with reference to FIG. 1 and has therefore not been illustrated.

There are connected to the port 205 a duct 208 in which is fitted a check-valve 210 as well as a pipe 211 which is in turn connected to a port 213 formed in the casing 204 and closed by a shut-off valve 212.

In the developed view of the worm (shown in FIG. 19), it is noted that, in a manner known per se and disclosed in French Pat. No. 2,177,171, the port 213 is inscribed within the width of a thread crest such as the crest 214; in this manner, two successive compression chambers are prevented from communicating with each other.

The shut-off valve 212 is located very near the port 213 so as to ensure that the volume of gas entrapped between said port and the shut-off valve when this latter is closed does not disturb the power consumption of the compressor by successive putting under pressure and expansion within the following chamber when the shut-off valve 212 is closed and when the two spaces compress in parallel.

The position of the port 213 is such that, during rotation, when the volume enclosed between two threads begins to move in front of said port, said volume is already closed-off by a pinion tooth and is therefore isolated from the intake.

it is clearly an advantage to associate the foregoing arrangement with another means for reducing delivery other than reduction of the intake pressure by throttling, whether this means consists of portions of casing which are displaced in sliding or rotational motion so as to retard the closure of the compression chambers or whether said means consist of early closure of the suction chambers.

Figure 20:
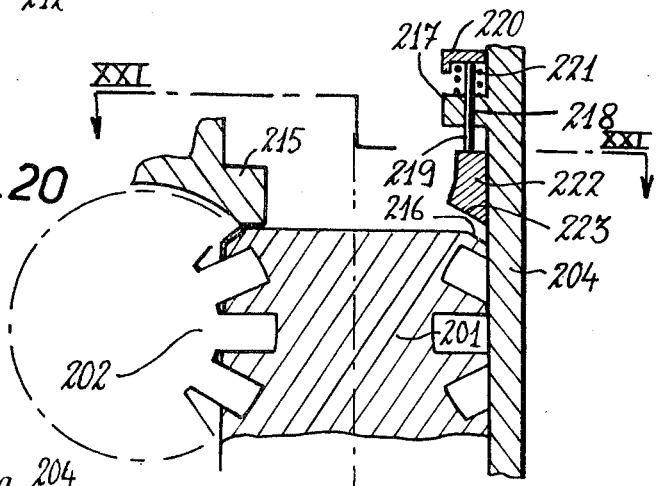
FIG. 20 is a part-sectional view taken along line XX—XX of FIG. 21 and showing a globoidal-worm compressor equipped with a regulating device in accordance with the invention.
Figure 21:
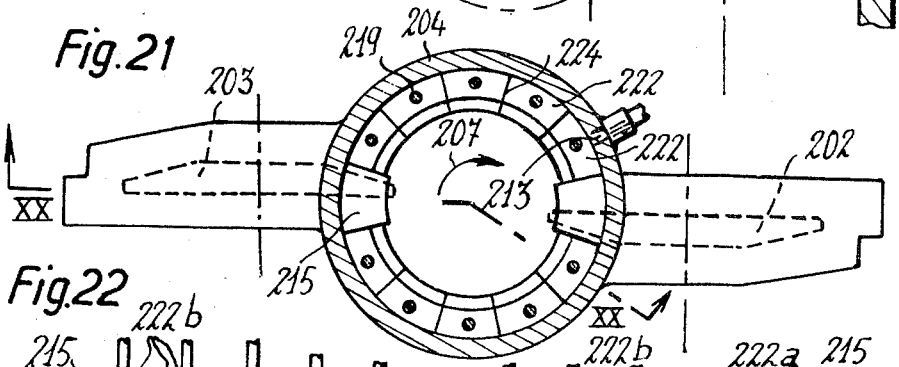
FIG. 21 is a sectional view taken along line XXI—XXI of FIG. 20.
Figure 22:
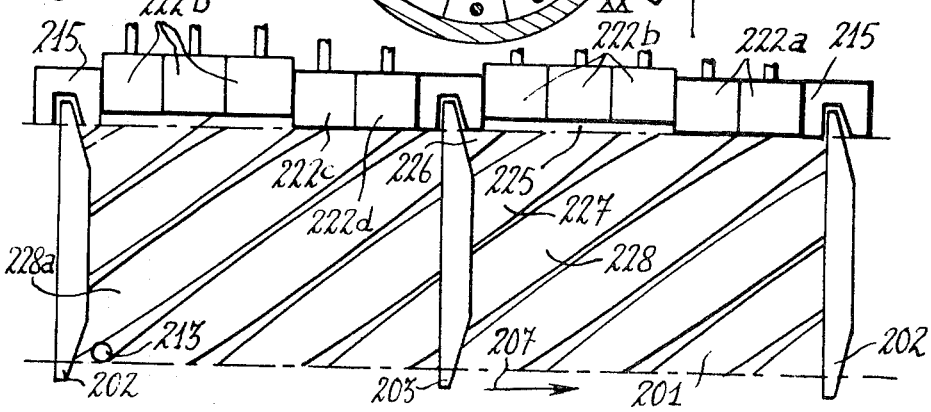
FIG. 22 is a developed view of the worm shown in FIG. 20.

One practical embodiment of this early closure system can be seen in FIGS. 20, 21, and 22. The casing 204 is provided with bosses 215 in which the pinions are capable of passing and which come into substantially fluid-tight contact with a cone 216 formed on the engagement end of the worm. Bosses 217 are formed on the casing extension and provided with bores 218 in which are slidably mounted plungers 219, each plunger being provided at one end with a head 220 which is aplied against springs such as 221 and at the other end with closure elements 222.

The end portion of each closure element 222 has the shape of a cone 223 which is complementary to the cone 216 so that, when a force is applied against the heads 220 by means which are not shown in the drawings and when said heads are brought to bear on the bosses 217, the cone 223 comes into substantially fluid-tight contact with the engagement cone 216 of the worm.

The closure elements 222 are disposed around the entire periphery of the casing and are therefore capable of sliding with respect to each other while remaining in lateral contact by means of substantially radial faces such as the face 224.

In FIG. 22, closure elements such as the element **222*a* are applied in fluid-tight contact against the worm while elements such as 222*b* remain in the raised position. The result thereby achieved is that chambers such as 226 or 227 which are formed between two successive threads can be filled with gas whereas a chamber such as 228** is isolated from the intake before having attained its maximum volume.

The pressure-volume diagrams are therefore identical with those described in connection with the embodiment of FIG. 9.

It will be noted that, in comparison with FIG. 17, the port 213 which is shown in FIGS. 21 and 22 has been displaced and communicates with a compression chamber at an earlier point in the cycle.

In the example shown in FIG. 22, it is seen that the two spaces are placed in series when the first two closure elements such as **222*c* and 222*d* have been displaced downwards. The port 213 then communicates only with a chamber 228*a*** which has already been isolated from the intake; at the same time, the volume of the chamber at the moment when this latter is isolated from the intake is between 50 and 80% of its maximum volume and preferentially of the order of 60%.

The ideal value which can be calculated in each case by consideration of the pressure-volume diagrams is achieved by suitably selecting the number of closure elements such as the element 222 and by suitably locating the faces such as the face 224.

It will be noted that in the embodiments herein described, the two pinions 202 and 203 must be in fluid-tight contact with that portion of the casing which surrounds these latter and must accordingly have only a small clearance between both faces and said casing.

It will be readily apparent that the present invention is not limited to the embodiments hereinbefore described and that many alternative forms of construction could be contemplated without thereby departing either from the scope or the spirit of the invention.

I claim:

1. A method for regulating double-acting rotary compressors in order to reduce the power consumption at low delivery, a compressor of this type being defined as comprising two compression spaces, each of said spaces being respectively provided with at least one inlet orifice and a discharge orifice and each constituted by at least one variable-volume compression chamber which is successively put into communication with a suction enclosure and finally put into communication with a discharge enclosure, in which said method consists in causing the two spaces aforesaid to discharge in parallel into a common duct in the vicinity of maximum delivery, wherein, in the case of deliveries below a predetermined value, the two spaces aforesaid are connected in series by joining the output of the first space to the second space at a point of said second space at which the compression chamber is already isolated from the suction enclosure.

2. A method according to claim 1, wherein the two compression spaces are placed in series when the delivery is below 80% of maximum delivery and preferably when said delivery is equal to a value between 50% and 70% of the maximum delivery.

3. A method according to claim 1 as applicable to a compressor having a volumetric compression ratio which is normally higher than 2, wherein the ratio aforesaid is returned substantially to the value of 2 in the case of the first compression space when the two spaces are connected in series.

4. A method according to claim 1, wherein the compression chambers are isolated from the suction enclosure before said chambers have attained their maximum volume.

5. A method according to claim 4, wherein the gas compressed by the first space is admitted into the compression chambers of the second space at a point at which said chambers have a volume between 50% and 70% of their maximum volume.

6. A regulated double acting rotary compressor comprising two compression spaces each constituted by at least one compression chamber provided with moving partition walls in cooperating relation with a casing, each of said spaces being respectively provided with at least one inlet orifice and a discharge orifice, wherein said casing is provided in the portion corresponding to one of said spaces with an additional orifice connected by a pipe to the discharge orifice of the other space, said pipe being provided with a shutoff valve, the dimension of said additional orifice being substantially inscribed within the contact area between said casing and one of the moving partition-walls aforesaid, and the position of said additional orifice being such that a compression chamber does not communicate simultaneously with said additional orifice and with any inlet orifice in any position of said moving partition-walls, thereby permitting the output flow of the first space to be added to the flow of the second space by operating said shutoff valve.

7. Apparatus according to claim 6 comprising a suction enclosure adapted to communicate with said inlet orifices and a check-valve placed within the casing at a distance from the discharge orifice of the first space, said distance being such that the volume of a compression chamber put into communication with said check-valve is substantially half the volume of said compression chamber when it stops communicating with said suction enclosure.

8. Apparatus according to claim 6 comprising displaceable closure elements slidably mounted to come into contact with the movable partition-walls of the compression chambers.

* * * * *